US007407167B1

(12) United States Patent
Chou

(10) Patent No.: US 7,407,167 B1
(45) Date of Patent: Aug. 5, 2008

(54) ROLLER SKATE SHOE WITH ROLLER ASSEMBLY

(76) Inventor: Yu-Chun Chou, P.O. Box 44-2049, Taipei (TW) 10668

( * ) Notice: Subject to any disclaimer, the term of this patent is extended or adjusted under 35 U.S.C. 154(b) by 0 days.

(21) Appl. No.: 11/979,077

(22) Filed: Oct. 31, 2007

(51) Int. Cl.
*A63C 17/08* (2006.01)

(52) U.S. Cl. ..... 280/7.13; 280/7.1; 280/841; 280/8; 280/13

(58) Field of Classification Search ..... 280/7.13, 280/7.1, 841, 8, 13
See application file for complete search history.

(56) References Cited

U.S. PATENT DOCUMENTS 5,934,691 A * 8/1999 Stivali ..... 280/11.212
6,322,088 B1 * 11/2001 Klamer et al. ..... 280/11.27
6,364,322 B1 * 4/2002 Lee ..... 280/11.27
6,450,659 B1 * 9/2002 Salatino ..... 362/103
6,485,169 B1 * 11/2002 Ragner ..... 362/500
6,536,785 B2 * 3/2003 Lee ..... 280/11.27
6,773,131 B2 * 8/2004 Salatino ..... 362/103
6,913,270 B2 * 7/2005 Wang ..... 280/11.24

* cited by examiner

*Primary Examiner*—Christopher Ellis
*Assistant Examiner*—Cynthia F. Collado

(57) ABSTRACT

A roller skate shoe has cavities, closing members and roller assemblies. A sole of the shoe is formed with the cavities. Two sides of each cavity are formed with notched slots. The closing member is accommodated in the cavity. The closing member has a closing side for closing the cavity, and is formed with two cut edges corresponding to the notched slots. The roller assembly mounted on the closing member includes a roller base, a roller body mounted in the roller base, and two control assemblies respectively mounted to two sides of the roller base corresponding to the cut edges and the notched slots. The roller assembly is separated from the cavity using the control assembly so that the closing member may be detached from the roller and reversed to close the cavity to prevent foreign objects from entering the cavity.

5 Claims, 5 Drawing Sheets

ROLLER SKATE SHOE WITH ROLLER ASSEMBLY

BACKGROUND OF THE INVENTION (1) Field of the Invention

The invention relates to a shoe, and more particularly to a roller skate shoe with a roller assembly.

(2) Description of the Prior Art

A shoe, in which a roller assembly is installed, can slide and is loved by the juvenile. The roller assembly of the roller skate shoe is also modified, as shown in FIG. 5. A roller mechanism 50 is disposed on a heel portion of a shoe pad 41 of a shoe body 40. The roller mechanism 50 is controlled by a pushbutton 52 so that a roller body 51 of the roller mechanism 50 can be shifted up and down. The pushbutton 52 projects over the heel portion of the shoe pad 41, and an external force pushes the pushbutton 52 to control the roller body 51 to protrude out or retract into the sole.

The roller body 51 of FIG. 5, which may be retracted into the sole, has the feature of multiple uses. However, the roller mechanism 50 is mounted in the heel space of the shoe pad 41, and a gap for preventing the interference between the roller body 51 and the circumference has to be kept. Thus, even if the roller body 51 is controlled to retract into the sole, the dust or foreign objects may enter a cavity 42 for accommodating the roller body 51 when the user walks, and the sole cannot be easily cleaned.

In addition, the pushbutton 52 projects out of the heel portion of the shoe pad 41 and tends to be touched by the foreign objects or stepped by others who are walking, thereby causing the roller body 51 to loss the sliding ability improperly and instantaneously.

In addition, the structure of the roller mechanism 50 is complicated and cannot be disassembled in a timesaving manner. Thus, the shoe cannot be easily cleaned, the cleanness of the shoe cannot be easily kept, and the dust on the surface of the roller body 51 also influences the rolling smoothness of the roller skate shoe.

SUMMARY OF THE INVENTION

In view of the above-mentioned problems, it is therefore an object of the invention to provide a roller skate shoe with a roller assembly, which may be detached from the shoe. In addition, when the roller assembly is removed, a sole of the roller skate shoe may have a closed surface to prevent foreign objects and dust from entering a cavity of the sole for accommodating the roller assembly.

The invention achieves the above-identified object by providing a roller skate shoe with a roller assembly. The shoe has an upper and a sole. The shoe is characterized in that:

the sole is formed with at least one non-circular concave cavity having an opening facing in a direction toward a bottom side of the sole, wherein two notched slots are formed on two opposite inner sides of the cavity;

a closing member is mounted in the cavity, wherein the closing member is to be accommodated within the cavity, the closing member has a closing side for closing the opening of the cavity, and the closing member is formed with two cut edges corresponding to the notched slots; and a roller assembly is mounted in the closing member and comprises a roller base correspondingly mounted in the closing member, a roller body mounted in the roller base, and two control assemblies, wherein the rotatable roller body is disposed in the roller base, the control assemblies each corresponding to the cut edge and the notched slot are mounted on two opposite sides of the roller base, the control assembly includes an elastic retractable collar, which may be forced by an external force to separate from the cut edge and the notched slot and to detach from the closing member.

Therefore, the invention has the following advantages according to the technological means of the invention.

First, the shoe has the cavity, into which the closing member having the corresponding shape is inserted. The roller assembly is mounted in the closing member, and the roller assembly matches with the notched slots of the cavity using the collars to make sure that the roller assembly can be firmly positioned and cannot be detached unintentionally but can be detached easily. The roller assembly can be separated from the closing member and the cavity by pressing the two collars. So, the roller assembly can be easily disassembled from the cavity completely.

Second, the control assembly is hidden in the cavity and cannot be unintentionally touched.

Third, after the roller assembly is disassembled, the sole may be kept to have a plane because the closing member can be reversed and inserted into the cavity. Thus, the closing side of the closing member can close the opening of the cavity. Therefore, when the shoe is worn, the foreign objects and dust cannot enter the cavity for accommodating the roller assembly and the cleanness of the shoe can be easily kept. When the shoe is worn by the user, the user may walk stably because no opening of the cavity of the sole exists.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

Figure 1:
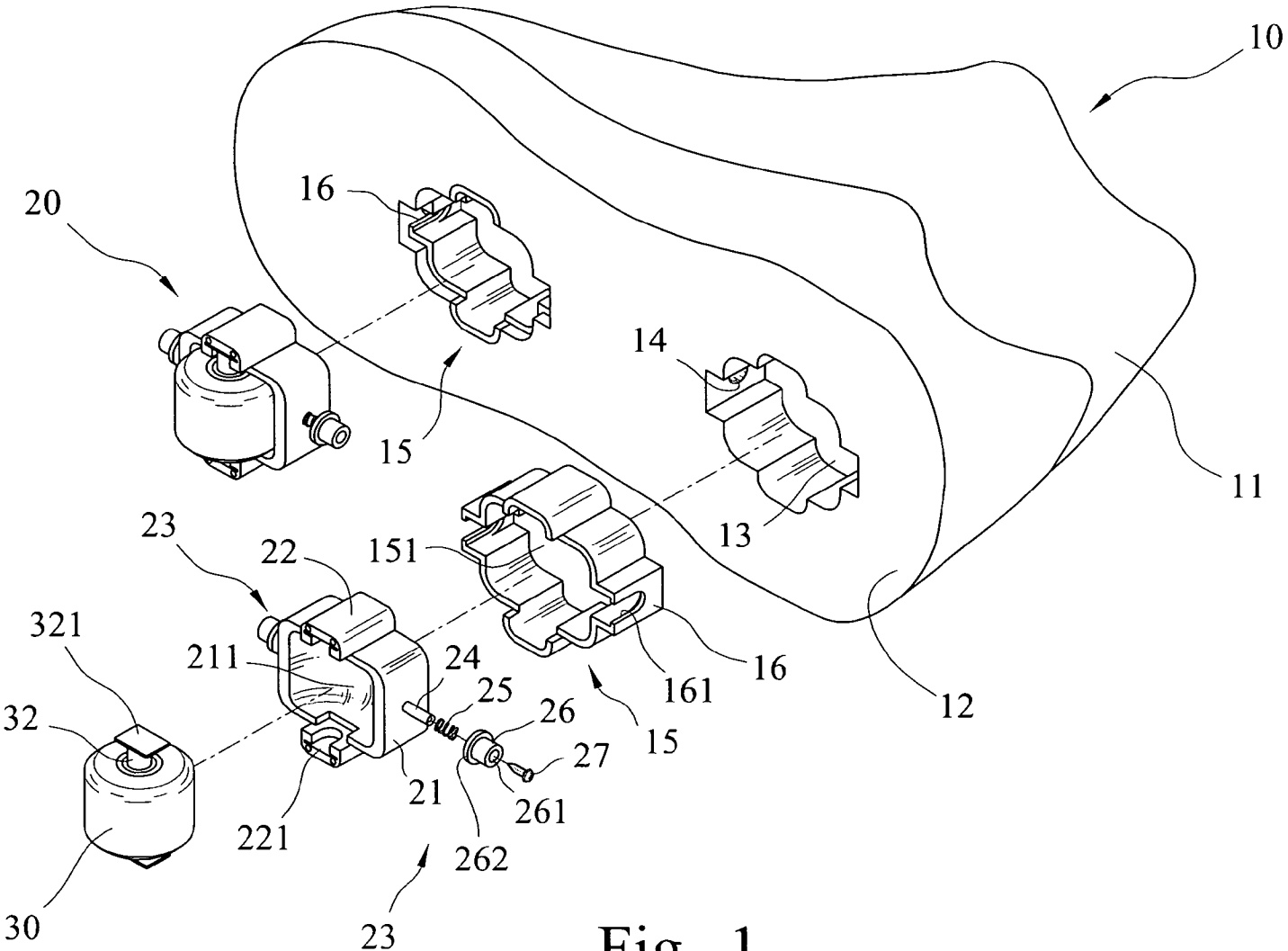
FIG. 1 is a pictorially exploded view showing a roller skate shoe according to a first embodiment of the invention.

The invention provides a roller skate shoe 10 with a roller assembly, as shown in FIG. 1. The shoe 10 has an upper 11, a sole 12, and closing members 15 and roller assemblies 20 mounted on a bottom side of the sole 12.

Figure 2:
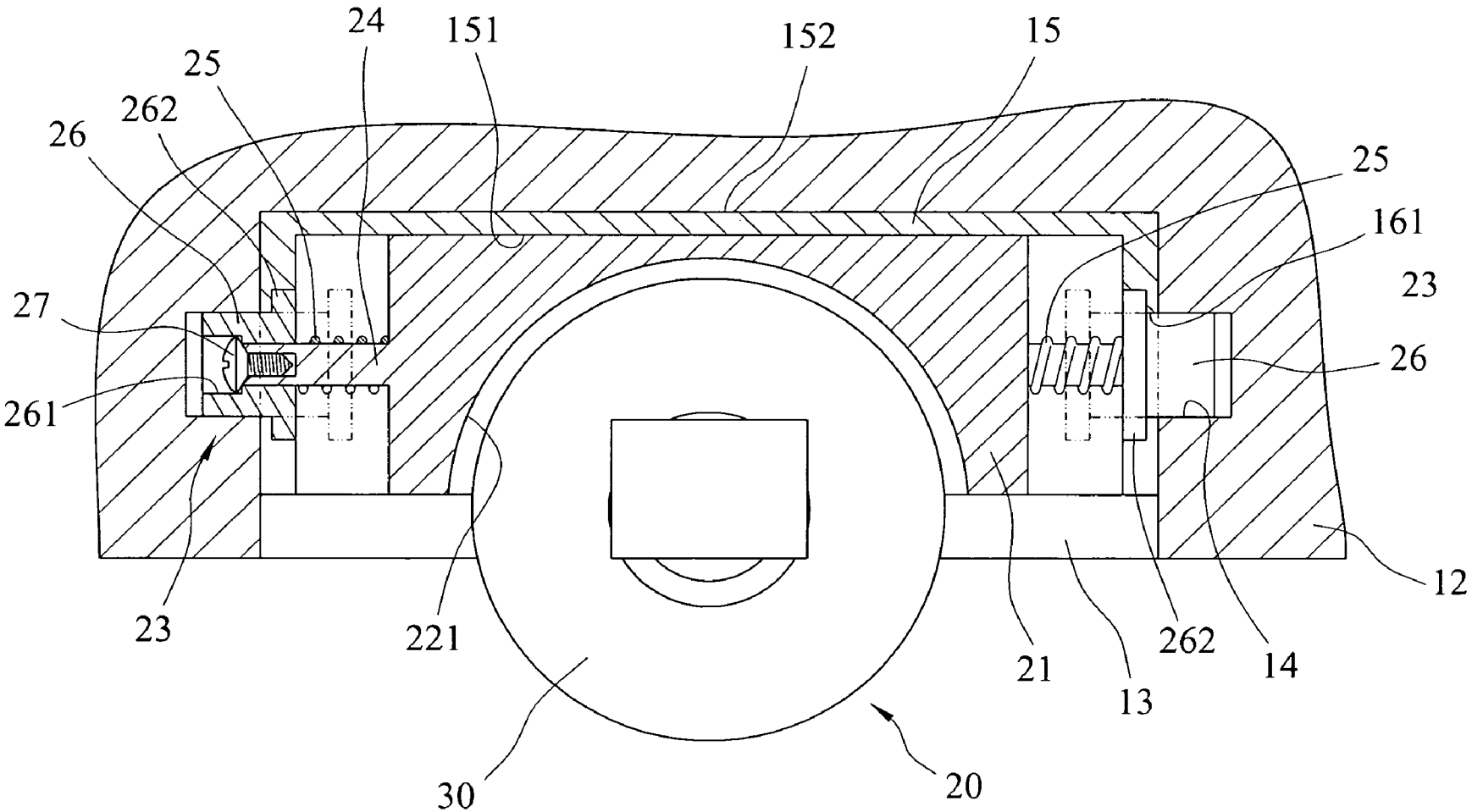
FIG. 2 is a cross-sectional view showing the roller skate shoe according the first embodiment of the invention.

As shown in FIGS. 1 and 2, the upper 11 and the sole 12 of the shoe 10 are integrally formed and no seam is formed between the upper 11 and the sole 12. Non-circular concave cavities 13 are formed on the sole 12 at positions close to the toe and the heel. The opening of the cavity 13 faces in a direction toward the bottom side of the sole 12. Two notched slots 14 are formed on two opposite inner sides of the cavity 13.

The closing member 15 is a box-like member having a cross-sectional area matching with that of the cavity 13 so that the closing member 15 may be fully inserted into the cavity 13 and presses against the cavity 13 tightly. The closing member 15 has an inner slot 151. The inner slot 151 has a closed end surface serving as a closing side 152. Two sides of the circumferential surface of the closing member 15 corresponding to the notched slots 14 are formed with projecting lugs 16. The lug 16 has a U shape and is aligned with a cut edge 161 of the notched slot 14.

As shown in FIGS. 1 and 2, the roller assembly 20 is correspondingly disposed in the closing member 15. The roller assembly 20 includes a roller base 21 correspondingly mounted in the closing member 15, a roller body 30 mounted in the roller base 21, and two control assemblies 23. The roller base 21 is a box-like base, in which an arced concave slot 211 is formed, and has two symmetrical protrusions 22. The protrusion 22 is formed with a thin clamping slot 221. The two control assemblies 23 are respectively mounted on two opposite sides of the roller base 21.

The control assembly 23 includes posts 24, springs 25 and collars 26. The posts 24 are mounted on the two sides of the roller base 21 corresponding to the cut edges 161 and the notched slots 14. The posts 24 are inserted into the springs 25 and the hollow collars 26, respectively. A counterbore 261 is formed on a center of each of the collars 26. One end of each of the collars 26 can enter the notched slot 14, and the other end of each of the collars 26 has a transversally extended flange 262 having a larger outer diameter. Each of the collars 26 is tightly fixed to the post 24 by a screw 27 passing through the counterbore 261 so that the collar 26 is axially retractable relative to the post 24 according to the spring 25. Thus, when the roller assembly 20 is mounted in the inner slot 151 of the closing member 15, the collars 26 of the control assembly 23 enters the notched slots 14 through the cut edges 161, and the flanges 262 stop the inner surfaces of the inner slots 151. A distance is kept between the flange 262 and an inner side of the cavity 13 so that the collar 26 can be actuated conveniently.

One roller body 30 is mounted in the concave slot 211 of the roller base 21. A roller shaft 32 is mounted to a center of the roller body 30 so that the roller body 30 can be rotated relative to the roller shaft 32. Two ends of the roller shaft 32 protruding over the roller body 30 are fixed to clamping pieces 321. Thus, the clamping pieces 321 may be inserted into the clamping slots 221 when the roller body 30 enters the concave slot 211 so that the roller body 30 can be positioned in the roller base 21 and roll relative to the ground and the shoe 10 can move relative to the ground.

As shown in FIG. 2, the cavity 13 matches with the lug 16 of the closing member 15 and the control assembly 23 is engaged with the lugs 16 and the notched slots 14 of the cavity 13. Thus, the roller assembly 20 cannot easily slide out, and the good fixing effect can be obtained.

Figure 3:
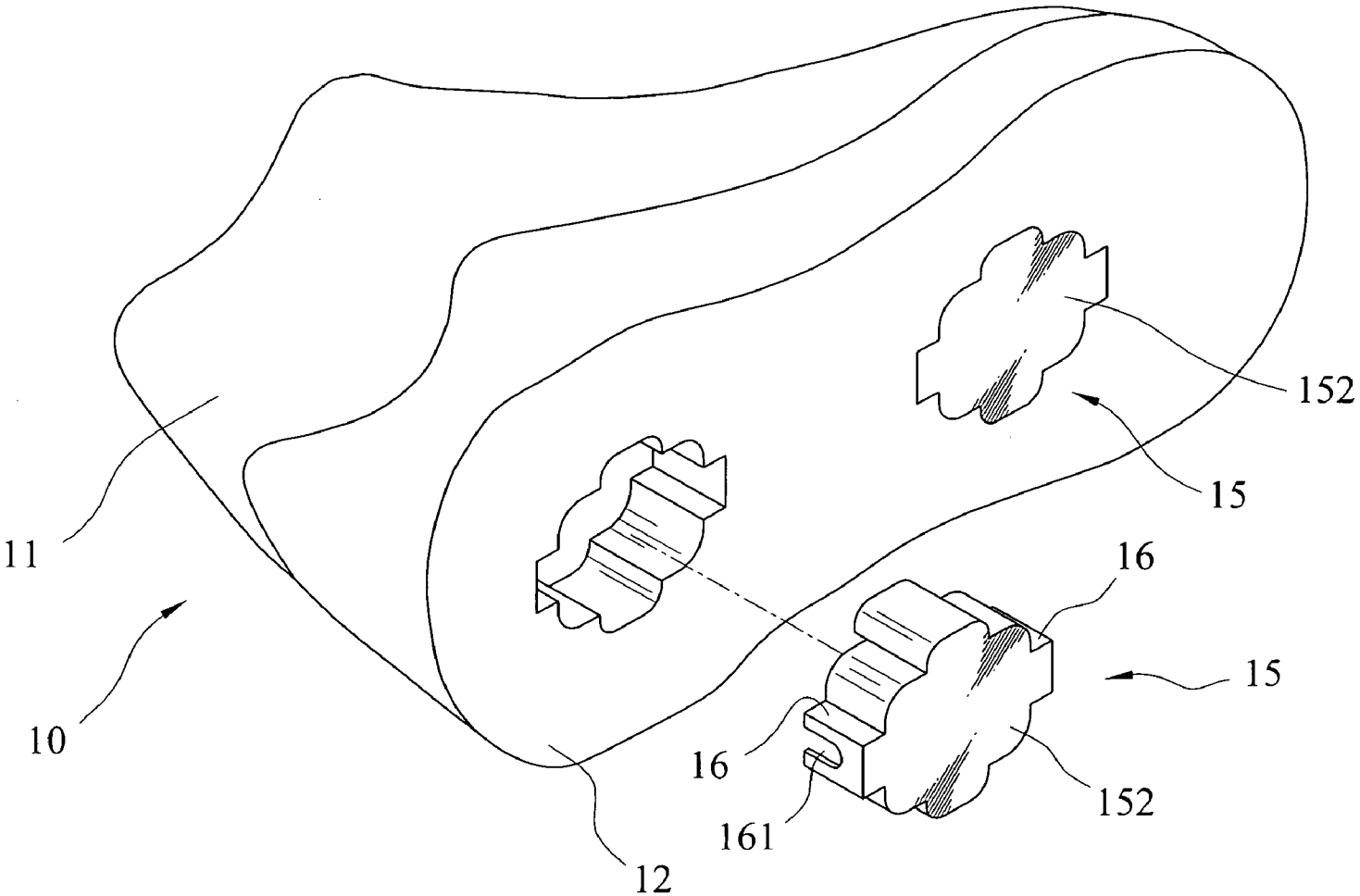
FIG. 3 is a pictorially exploded view showing a roller skate shoe according to a second embodiment of the invention, wherein the roller assembly is detached from the closing member, and the closing member is reversed to close the sole.
Figure 4:
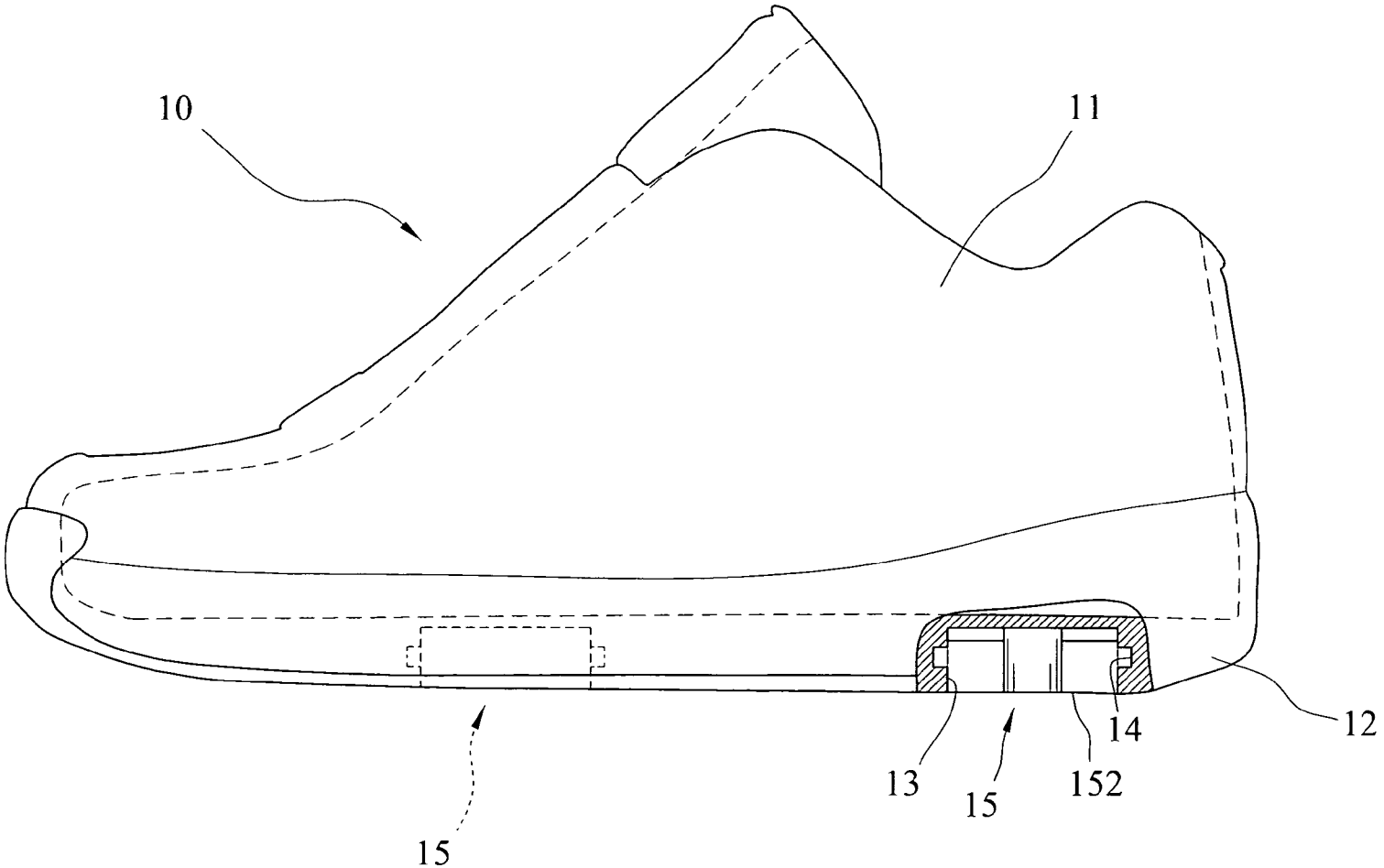
FIG. 4 is a cross-sectional view showing the roller skate shoe according to the second embodiment of the invention, wherein the roller assembly is detached from the closing member, and the closing member is reversed to close the sole.
Figure 5:
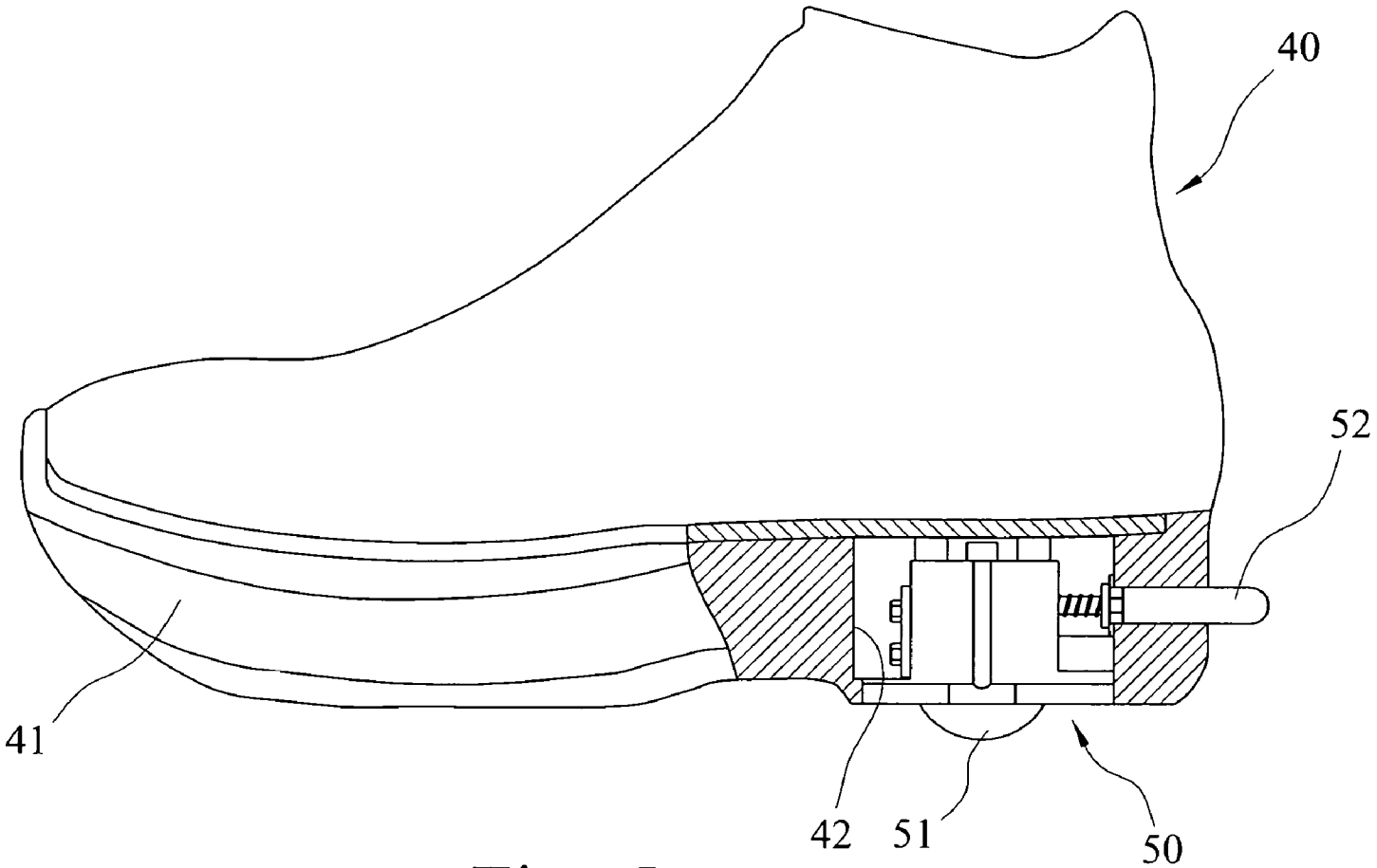
Fig 5 (Prior Art)
FIG. 5 is a cross-sectional view showing a conventional roller skate shoe.

Also, as shown in FIGS. 2 and 3, if the shoe 10 without the roller function is used for walk, the flanges 262 of the collar 26 on two sides of the control assembly 23 are simultaneously pressed to compress the springs 25 so that the collars 26 slide along the posts 24 and are separated from the cut edges 161 and the notched slots 14. Thus, the roller assembly 20 can be taken out from the inner slot 151 of the closing member 15. Next, the closing member 15 is also taken out. Because the space of the cavity 13 is free, the closing member 15 is reversed, as shown in FIGS. 3 and 4 so that the closing side 152 faces outwards. Then, the closing member 15 is inserted into the cavity 13 so that the closing side 152 is flush with the sole 12 and the cavity 13 of the sole 12 is closed. Consequently, when the shoe 10 is worn, foreign objects are free from entering the cavity 13, and the cleanness of the cavity 13 can be kept and the cavity 13 can be easily cleaned.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A roller skate shoe having an upper and a sole, characterized in that:

the sole is formed with at least one non-circular concave cavity having an opening facing in a direction toward a bottom side of the sole, wherein two notched slots are formed on two opposite inner sides of the cavity;

a closing member is mounted in the cavity, wherein the closing member is to be accommodated within the cavity, the closing member has a closing side for closing the opening of the cavity, and the closing member is formed with two cut edges corresponding to the notched slots; and a roller assembly is mounted in the closing member and comprises a roller base correspondingly mounted in the closing member, a roller body mounted in the roller base, and two control assemblies, wherein the rotatable roller body is disposed in the roller base, the control assemblies each corresponding to the cut edge and the notched slot are mounted on two opposite sides of the roller base, the control assembly includes an elastic retractable collar, which may be forced by an external force to separate from the cut edge and the notched slot and to detach from the closing member.

2. The roller skate shoe according to claim 1, wherein the upper and the sole of the shoe are integrally formed.

3. The roller skate shoe according to claim 1, wherein the closing member is a box-like member, an inner slot is formed in the closing member, a circumferential surface of the closing member corresponding to the notched slots is formed with projecting lugs, the lug matches with the notched slot, and the lug is formed with the cut edge having a U-shape.

4. The roller skate shoe according to claim 1, wherein the roller base of the roller assembly is a box-like base formed with an arced concave slot, the roller base has two symmetrical protrusions at two sides thereof, the protrusion is formed with a clamping slot, the roller base further has the other two sides for mounting the control assembly, a roller shaft is rotatably mounted on a center of the roller body, and two clamping pieces are fixed to two ends of the roller shaft projecting over the roller body so that the roller body enters the concave slot and the clamping pieces are inserted into the clamping slots and thus positioned in the roller base.

5. The roller skate shoe according to claim 1, wherein the control assembly comprises posts, springs and collars, the posts are mounted on two sides of the roller base corresponding to the cut edges and the notched slots, the posts are inserted into the springs and the hollow collars, respectively, a counterbore is formed on a center of each of the collars, one end of each of the collars can enter the notched slot, the other end of each of the collars has a transversally extended flange having a larger outer diameter, each of the collars is tightly fixed to the post by a screw passing through the counterbore so that the collar is axially retractable relative to the post, the flange stops an inner surface of the closing member, and a distance is kept between the flange and an inner side of the cavity so that the collar can be actuated conveniently.

* * * * *